United States Patent [19]

Keim

[11] 4,014,545

[45] Mar. 29, 1977

[54] RING TOSS GAME

[76] Inventor: Roy L. Keim, 1156 N. St. Francis St., Wichita, Kans. 67214

[22] Filed: Feb. 6, 1976

[21] Appl. No.: 655,976

[52] U.S. Cl. ..... 273/95 H; 273/96 B

[51] Int. Cl.[2] ..... A63B 67/06

[58] Field of Search ..... 273/95 R, 95 H, 96 R, 273/96 B, 102 R, 100

[56] References Cited

UNITED STATES PATENTS

| | | | |
|---|---|---|---|
| 1,126,704 | 2/1915 | Chevalier | 273/100 |
| 2,085,610 | 6/1937 | Schrickel | 273/96 B |
| 2,545,615 | 3/1951 | Hatley | 273/95 H |
| 3,017,185 | 1/1962 | Marshall | 273/100 |

FOREIGN PATENTS OR APPLICATIONS

| | | | |
|---|---|---|---|
| 643,952 | 9/1937 | Germany | 273/96 B |
| 1,166,671 | 3/1964 | Germany | 273/96 B |
| 1,078,915 | 3/1960 | Germany | 273/96 B |

*Primary Examiner*—Anton O. Oechsle
*Assistant Examiner*—Lawrence E. Anderson
*Attorney, Agent, or Firm*—Jack D. Slobod

[57] ABSTRACT

An aerial game for play by two opposing teams on a square playing court having a central circular scoring zone, an annular neutral zone about the scoring zone and division lines dividing the remainder of the court in half defining two regions for tossing of an annular ring by the respective teams to the scoring zone includes ring catching implements for each player. The implements are formed by a shaft having a bulbous spherical head at an upper end dimensioned for sliding passage through the inside diameter of the ring, a handgrip at a lower end, and a radially projecting flange intermediate the two ends for supporting the ring when caught.

3 Claims, 5 Drawing Figures

RING TOSS GAME

FIELD OF THE INVENTION

The present invention relates generally to competitive sports for two opposing teams and to ring toss games. In its particular aspects the present invention relates to a ring toss game for play on a playing court having a central scoring zone into which players are maneuvered carrying ring catching implements.

BACKGROUND OF THE INVENTION

Competitive sports of the type in which goals are made at a particular region of a playing court or field provide great excitement and enjoyment because of the complex strategies which may be employed in maneuvering to the goal region. Further, various ring toss games have heretofore been known in which rings are thrown over a fixedly positioned post to achieve a goal.

OBJECTS OF THE INVENTION

It is an object of the invention to provide an aerial game in which a ring is thrown about a playing court to be caught in a goal region of the court on ring catching implements carried by the players.

It is a further object of the present invention to provide a highly exciting competitive sport utilizing a ring and ring catching implements.

SUMMARY OF THE INVENTION

Briefly, the aforementioned and other objects of the present invention are satisfied by providing an aerial game for play by two opposing teams on a playing court having a central circular region defining a scoring or goal zone. An annular ring is provided for tossing about the court and each player carries a ring catching means formed by a shaft having a spherical bulbous head at an upper end dimensioned for sliding passage through the inside diameter of the ring. A handgrip is provided at a lower end of the shaft and a flange radially projecting from the shaft intermediate the upper and lower ends thereof serves a support for the ring when caught.

The scoring zone is surrounded by an annular neutral zone from which the ring may not be tossed to a player stationed at the scoring zone. The remainder of the court about the neutral zone is divided in half to form two opposed regions respectively for the two teams to toss the ring toward the scoring zone.

The two opposed regions are divided into sectors about the neutral zone. Different point values may be assigned to goals made by throwing the ring from the different sectors. Additionally, a band of the neutral zone is formed to define a subzone at which all players are positioned at the start of play.

The game makes possible the use of complex strategies for maneuvering a player into the scoring zone to catch the ring for a goal.

Other objects, features and advantages of the present invention will become apparent upon perusal of the following detailed description of the preferred embodiment thereof when taken in conjunction with the appended drawing wherein.

DETAILED DESCRIPTION

Figure 1A:
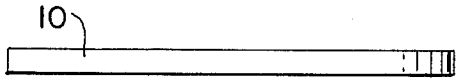
FIG. 1A and FIG. 1B are aligned elevational views of a ring and ring catching implement for the game of the present invention.
Figure 3:
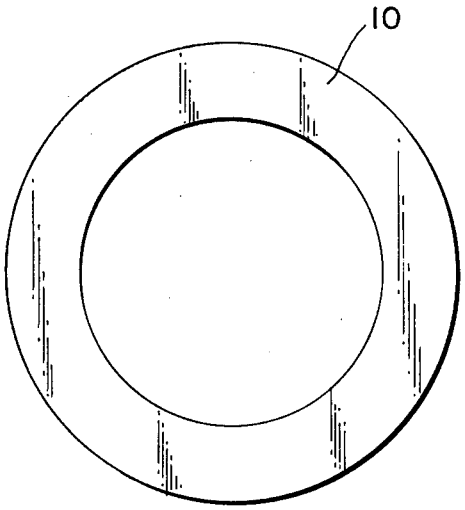
FIG. 3 is a top view of the ring in FIG. 1A.

Referring first to FIGS. 1A and 3, there is illustrated an annular ring 10 which is thrown or tossed in the game of the present invention. The ring 10 is preferably made of a semi-rigid plastic or rubber material such as polyethylene and preferably has an outside diameter of six inches and an inside diameter of four inches. The thickness of ring 10 is chosen so that it weighs approximately one half of a pound.

Figure 1B:
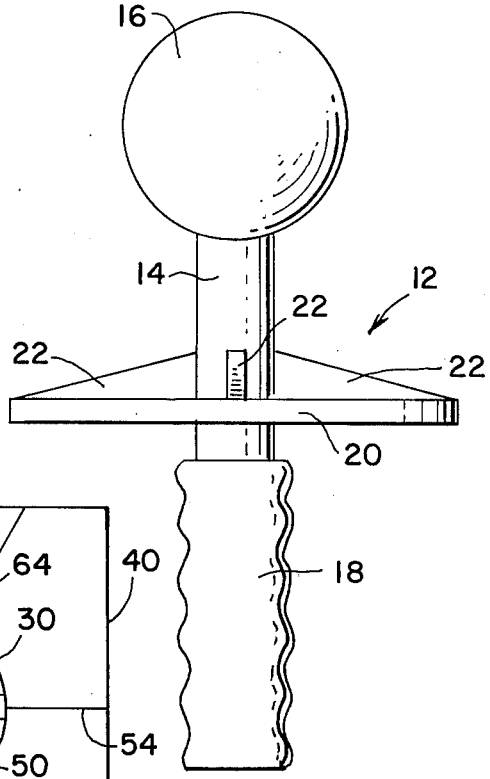
Figure 2:
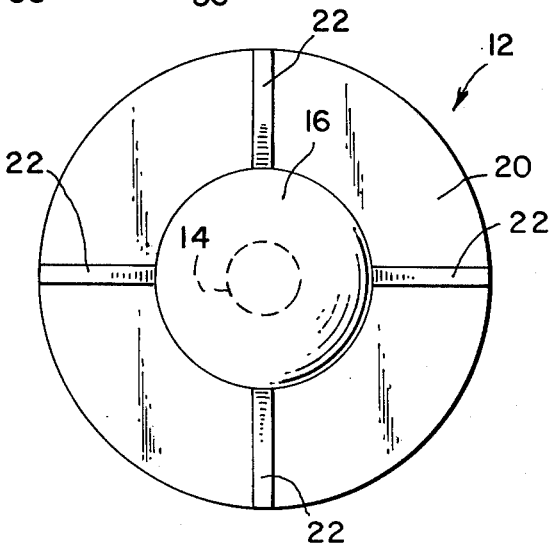
FIG. 2 is a top view of the ring catching implement in FIG. 1B.

The ring 10 is caught on a ring catching implement 12, illustrated in FIGS. 1B and 2. The implement 12 comprises an elongated cylindrical shaft 14, on the order of one inch in diameter, which has an integral bulbous spherical head 16, at its upper end. The head 16 is preferably three inches in diameter for an appropriate sliding fit through the inside diameter of ring 12. At the lower end of shaft 14, a bicycle type handgrip 18 is formed.

Intermediate the upper and lower ends of shaft 14, a circular flange 20 of about six inches in diameter projects radially from the shaft for supporting the ring 10 when caught. Four upstanding radially elongated triangular gussets 22 interconnect the shaft 14 and top side of flange 20 for strengthening the flange. The gussets 22 are spaced apart at ninety degree increments about the shaft 14 and flange 20.

Figure 4:
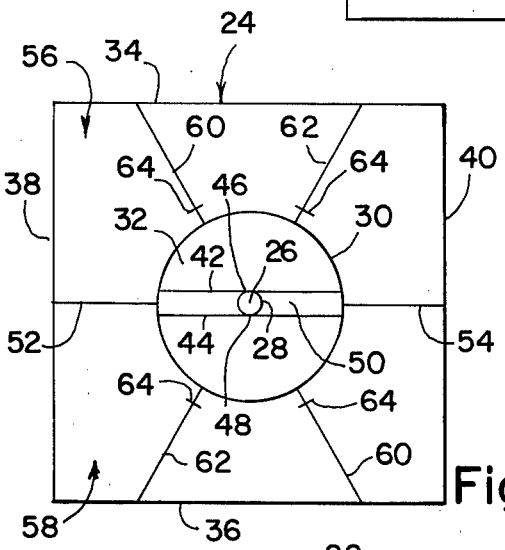
FIG. 4 is a plan view of a playing court for the game of the present invention.

The game of the present invention is played on a square court 24, illustrated in FIG. 4, which is preferably 54 feet on a side. A central circular scoring zone 26 is formed at the center of court 24 delineated by a circular boundary 28 of preferably four feet in diameter. A second circular boundary 30, of preferably 24 feet in diameter is provided concentric with boundary 28. An annular neutral zone 32 is defined between boundaries 28 and 30.

The periphery of court 24 is defined by a pair of opposed end lines 34 and 36 and a pair of opposed side lines 38 and 40. A pair of parallel spaced-apart lines 42 and 44, directed parallel to end lines 34 and 36, are respectively tangent to boundary 28 at points 46 and 48 and terminate their opposite extremes at boundary 30. Between the two lines 42 and 44, excluding the scoring zone 26, there is defined a strip 50 forming a sub-zone of neutral zone 32 on which the players are positioned at the start of play.

A pair of colinear boundaries 52 and 54, directed parallel to end lines 34 and 36, run from opposite sides of boundary 30 respectively to the side lines 38 and 40. Boundaries 34 and 36 divide the remainder of court 24 lying outside of boundary 30 in half into two regions 56 and 58. Each of the regions 56 and 58 are further subdivided into three parts by sector lines 60 and 62 spaced sixty degrees apart and radiating symmetrically from boundary 30 to the end lines 34 and 36. The lines 60 and 62 also make an angle of sixty degrees with the end lines 34 and 36.

Along the portions of the sector lines in each of the regions 56 and 58, perpendicular lines 64 of approximately three feet in lengths are marked off at locations spaced approximately two feet from boundary 30.

PLAYING THE GAME

The game is played by two opposing teams each which may consist of 2 or more players. Each player carries a ring catching implement 12 and a single ring 10 is utilized.

Play is started with all players positioned in the starting subzone 50 of neutral zone 32. At that time it is determined which team shall have possession of ring 10. This determination is conveniently accomplished by two opposing players jumping for the ring which is tossed straight up by an official in the nature of a jump ball as in basketball. Other techniques, for determination of initial possession of ring 10 are also possible.

The object of the game is to score a goal by maneuvering a player into the scoring zone 26 and tossing the ring to the player to be caught with implement 12. The opposing team can block the ring of the player tossing the ring in the nature of play in basketball. Neither team may toss the ring 10 from the neutral zone 32 to scoring zone 26. One team may toss the ring from only region 56 to the scoring zone while the other team may toss the ring only from region 58 to the scoring zone.

The sector lines 60 and 62 divide the regions 56 and 58 each into three sub-regions. Different score values are preferably assigned for goals achieved by tossing the ring 10 from different ones of the sub-regions to add further excitement to the game. Additionally, the lines 64 are used as safety lines during the start of play. A player leaving the starting sub-zone 50 must touch one of the safety lines 64 before tossing the ring 10 to the scoring zone 26. Further, the lines 64 may be used as free throw lines in the event of a foul.

While the preferred embodiment of the present invention has been described in specific detail, it should be understood that numerous modifications, additions and omissions in the details thereof are possible within the intended spirit and scope of the invention claimed herein.

What is claimed is:

1. An aerial game for play by two opposing teams comprising: a playing court; an annular ring for throwing within said playing court; a scoring zone at the center of said playing court; a pair of mutually exclusive regions on said playing court about said scoring zone for said respective opposing teams to throw said ring towards said scoring zone; a ring catching means for each member of said opposing teams comprising a shaft having a spherical head at an upper end of said shaft dimensioned for sliding passage through the inside diameter of said ring; a handgrip at a lower end of said shaft and a flange intermediate said upper and lower ends projecting radially of said shaft for supporting said ring when caught; said spherical head comprising means for substantially centering said ring about said head during said passage.

2. The game of claim 1 wherein said scoring zone is defined by a first circular boundary and said court further comprising a second circular boundary located concentrically about said first circular boundary defining an annular neutral zone between said first and second circular boundaries, and boundary means dividing the remainder of said court about said neutral zone in half to form said pair of regions.

3. The game of claim 1 wherein said spherical head has a diameter of substantially three quarters of the inside diameter of said ring.

* * * * *